United States Patent [19]

Fagerstedt et al.

[11] 3,979,926

[45] Sept. 14, 1976

[54] FIBER FEEDING DEVICE FOR A PILE FABRIC KNITTING MACHINE

[75] Inventors: Per-Erik Fagerstedt, Ekenas; Pekka Solin, Karjaa, both of Finland

[73] Assignee: Oy Lillja Pile AB, Finland

[22] Filed: Mar. 24, 1975

[21] Appl. No.: 561,402

[30] Foreign Application Priority Data

Apr. 1, 1974 Finland ..... 995/74

[52] U.S. Cl. ..... 66/9 B; 19/105; 19/145.7

[51] Int. Cl.[2] ..... D04B 9/14

[58] Field of Search ..... 66/9 B; 19/105, 145.7

[56] References Cited

UNITED STATES PATENTS

| | | | |
|---|---|---|---|
| 292,582 | 1/1884 | Prosser | 19/145.7 |
| 3,122,904 | 3/1964 | Brandt | 66/9 B |
| 3,495,422 | 2/1970 | Miller | 66/9 B |

*Primary Examiner*—Dorsey Newton
*Attorney, Agent, or Firm*—Ladas, Parry, Von Gehr Goldsmith & Deschamps

[57] ABSTRACT

A fiber feeding device for a multi-color pile fabric knitting machine. The device comprises several units feeding fiber roving of different color onto a common carding cylinder. Said fiber feeding units are operated independently from each other.

6 Claims, 2 Drawing Figures

FIBER FEEDING DEVICE FOR A PILE FABRIC KNITTING MACHINE

Figure 1:
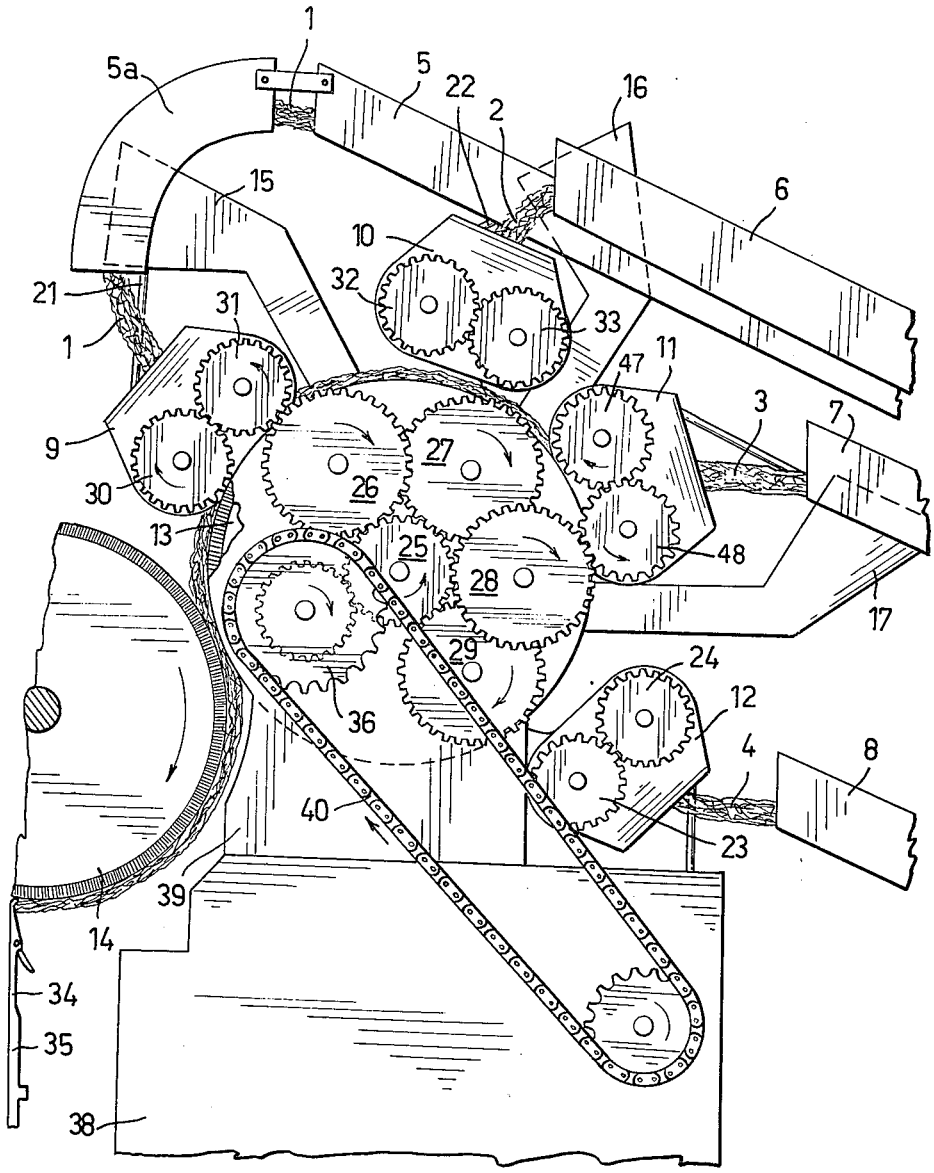

The present invention concerns a fibre feeding device for a pile fabric knitting machine, wherein the fibre roving is fed through a pair of feed rollers onto a carding cylinder from which a carding drum, which rotates at a speed higher than that of said cylinder, takes the fibres and carries them to the needles of a needle cylinder.

A fibre feeding device commonly used in pile fabric knitting machines has been described in the U.S. Pat. No. 3,188,834. In this device the feeding of the fibre roving onto the carding cylinder is performed by means of several subsequent feed rollers, which, in order to lengthen and widen the fibre roving, are operated at successively increasing speeds. These feed roller pairs are mounted on a frame, and the frame with its feed rollers can be moved as one unit to the working position connected with the cylinder, and off such position. This device is, however, of a complicated construction, in particular as regards the transmission system driving the fibre feeding rollers. It involves many moving parts, which are worn rapidly, and therefore the device requires frequent servicing. A drawback resulting from the lengthening of the fibres in the device is, for example, that the fibre roving often is wound around the lengthening rollers, whereby the device will easily break down. Also, in connection with the lengthening, breaking of fibres occurs, and the resulting dust is hard to remove. Dust is also carried along with the roving, whereby stains are produced in the product to be manufactured.

Nowadays attempts are made to produce more and more versatile products of e.g. imitated fur, in which a great variety of fibres of different colours are changed and mixed. Known fibre feeding devices are, however, of such a complicated construction and operation that production of multicolour products has required very large machines or complicated combinations of equipment, in which the capacity has been very low.

An object of the present invention is to provide a simple and versatile fibre feeding device of a good production capacity in particular for a pile fabric knitting machine to be used for manufacturing multi-colour products. This has been achieved by means of the fibre feeding device in accordance with the present invention, which comprises

- at least two first rotating driving means placed near the cylinder circumference,
- a second driving means, which rotates said first driving means, and
- at least two fibre feeding units, each of which provided with third driving means rotating a pair of feed rollers, and each movable, independently from the other fibre feeding units, between a working position, in which said third driving means are in driving contact with the corresponding first driving means thus producing feeding of fibres onto the cylinder, and a rest position, in which there is no driving contact mentioned above and, thus, no feeding of fibres takes place.

Among the advantages of the device in accordance with the present invention should be mentioned the ease of maintenance, resulting from the simple construction, and the low wear of the components, resulting from the low speeds used in the transmission. Stretching of the fibre roving is also unnecessary.

Below, the invention will be described more closely with reference to the attached diagrammatic drawing, wherein a preferred embodiment of the fibre feeding device in accordance with the invention is shown.

Figure 2:
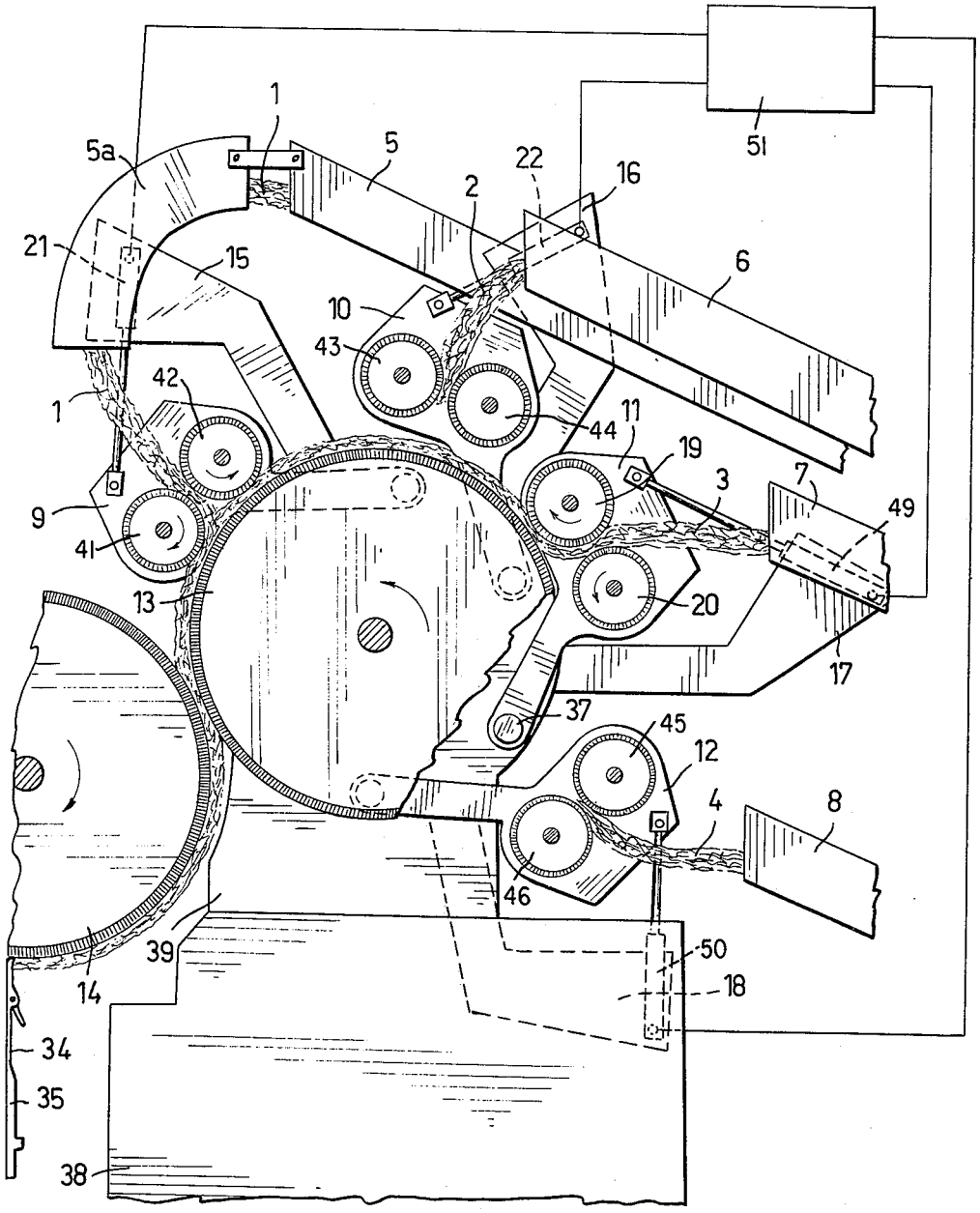

FIG. 1 is a side view of the feeding device according to the invention showing the driving gear system, and FIG. 2 is a sectional side view the section being taken approximately along the middle line of the device.

Referring now to FIGS. 1 and 2, on the frame 38 of a pile fabric knitting machine, side plates 39 are fastened, to which plate the carding cylinder 13 and most important parts of the fibre feeding device itself have been attached. The driving power of the device is obtained e.g. from a shaft connected to the main driving machinery.

Numerals 1, 2, 3 and to 4 denote four fibre rovings, preferably of different colours. The rovings come to the fibre feeding device along feeding chutes 5, 6, 7 to 8. To one of the side plates 39 at the cylinder 13 ends, is attached four fibre feeding units 9, 10 and to 12, one for each roving.

Each fibre feeding unit is fastened to the side plate 39 pivotably, e.g., around a screw pin 37. In the drawing this fastening has been shown in more detail only in connection with the fibre feeding unit 11, FIG. 2. The fibre feeding units 9 to 12 are placed so that they substantially follow the circumference of the cylinder 13. In each fibre feeding unit there is a pair of carding feed rollers 41, 42, 43, 44 19, 20, 45, 46, between which rollers the roving is fed onto the cylinder 13. From the carding cylinder 13 a doffer roll 14 rotating at a speed higher than that of the cylinder 13 takes the fibres and carries them to the latch needles 34 of a circular needle cylinder 35, shown schematically. The fibre feeder rollers 41, 42, 43, 44, 19, 20, 45, 46 are driven by pairs of cogwheels 30, 31, 32, 33; 47, 48; 23, 24, one pair for each fibre feeding unit, the wheels of each pair being in driving engagement with each other. The pivoting movement of the fibre feeding units 9, 10, 11 and 12 15, in the embodiment in accordance with the drawing, produced by means of working cylinders 21, 22, 49 and 50 which are attached to brackets 15, 16, 17 and 18 mounted on one of the side plates 39. Said working cylinders may preferably be pressure air cylinders.

Further, at each fibre feeding unit, a cogwheel, 26, 27, 28 and 29, is mounted on the side plate, whereby both the fibre feeding units and these cogwheels are placed advantageously to substantially follow the circumference of the cylinder 13. Each of the cogwheels 26 to 29 is in driving contact with a centrally placed cogwheel 25. This central cogwheel 25 is in turn connected to the driving shaft of the main machinery. The latter connection between the central cogwheel 25 and the driving shaft may be of any suitable kind; in FIG. 1 it has been illustrated by means of a cogwheel 36 driving the central cogwheel 25, and in turn driving by a chain transmission 40. In the drawing, neither the driving shaft of the machine nor the coupling between it and the chain 40 has been shown but may be of any suitable kind known per se.

During operation, the chain 40 and the cogwheel 36 continually rotate the central cogwheel 25, which in turn rotates the cogwheels 26 to 29. The pressure air cylinders actuating the fibre feeding units 9 and 12 are controlled preferably automatically by means of a programme prepared in accordance with the product at each particular time produced, as for example by means 51 which can selectively move each fibre feeding unit. The fibre feeding units 9 to 12 are arranged in such a relation to the cogwheels 26 to 29 that the shifting to the working position takes place by means of an eccentric movement in relation to the cogwheel 26 to 29 concerned. Hereby a gliding engagement of the cogs is obtained, and as the cogs are shaped such that they do not hit with the tips against each other, the possibility of damage is very little. Impacts on other components during the coupling stage have been eliminated by the arrangement that the entire stroke of the piston of the pressure air cylinders is used for the work movement, whereby the piston itself functions as the limiter of the movement. The working depth of the feeding units 9, 10, 11, 12 is adjusted by mounting the pressure air cylinders 21, 22, 49, 50 on the bracket 15, 16, 17 18 respectively at the desired distance. With the same movement, the pressure air cylinder presses the feeding unit to an adjustable working distance (about 0.3 mm) and couples one of its cogwheels, e.g. 31; 33, 48 or 23, to the corresponding cogwheel 26, 27, 28 or 29. The shape of the cogs is such that the distance can be changed a little and that they go into their engagement in all of their positions.

When the feeding unit is in the working position, said cogwheel e.g. 26 to 29 thus rotates the cogwheels 30, 31 of the corresponding feeding unit, and its feed rollers 41, 42, whereby the fibres pass between said rollers onto the cylinder 13. In the example case of the drawing, the feeding units 9 and 11 are in the working position, whereby a mixture of the fibres 1 and 3 is obtained.

In the fibre feeding units the feed rollers have been covered with card tape, the needles of which overlap each other preferably about 2 mm. Hereby a very even distribution of the fibres onto the cylinder 13 is achieved.

The fibre feeding device shown in the drawing has four separate fibre feeding units. By means of four feeding units, it is possible to produce, for example, following patterns:

A. By using the feeding components one at a time, imitation furs of 1, 2, 3, or 4 colours are obtained with pure colours and without mixing the colours together.

B. Mixtures of colour and/or fibre, 6 alternatives

| | |
|---|---|
| 9 – 10 together<br>9 – 11 together<br>9 – 12 together<br>10 – 11 together<br>10 – 12 together<br>11 – 12 together | 2 components in each |

and 4 alternatives

| | |
|---|---|
| 9 – 10 – 11 together<br>9 – 10 – 12 together<br>9 – 11 – 12 together<br>10 – 11 – 12 together | 3 components in each |

and all of them at the same time in the working position, yielding one four-component mixture.

Also, it is possible to take all the feeding units out of operation, whereby the empty sewing base becomes visible.

Above, the possibilities of use of one fibre feeding device have been explained. In pile fabric knitting machines, often eight or more such devices are used together, whereby the possibilities of patterning are multiplied while each feeding unit operates independently.

The device of the invention may be made further more complicated by using a larger cylinder 13, whereby more feeding units can be placed along the enlarged circumference. The device may also be made unevenly feeding, whereby the product becomes, for example, spotted.

What we claim is:

1. A fibre feeding device for a pile fabric knitting machine, wherein the fibre roving is fed through a pair of feed rollers onto a carding cylinder from which a doffer roll rotating at a speed higher than that of said cylinder takes the fibres and carries them to the needles of a needle cylinder, comprising a first rotating driving means, a plurality of second rotating driving means placed near the periphery of said carding cylinder and driven by said first rotating means, a plurality of fibre feeding units pivotably mounted along the periphery of the carding cylinder, each unit comprising a pair of feed rollers, third rotating driving means corresponding to one of said plurality of second driving means for rotating the feed roller included in each fibre feeding unit and means for selectively moving each fibre feeding unit from a working position in which said third rotating driving means are driven by its corresponding second rotating driving means to feed fibres between the feed rolls onto the carding cylinder, to a rest position in which there is no driving contact between the second and the third driving means so that no feeding of fibres takes place, and back to said working position to enable the device to selectively feed and or mix different fibres.

2. A fibre feeding device as in claim 1, wherein said first, second and third rotating driving means are cogwheels.

3. A fibre feeding device as in claim 1, wherein said first rotating drive means is positioned centrally with respect to said second rotating driving means.

4. A fibre feeding device as in claim 1, wherein said means for moving the fibre feeding unit from rest position to working position and back to rest position is a working cylinder.

5. A fibre feeding device as in claim 4, wherein said working cylinder moves a complete stroke to move the fibre feeding unit from rest position to working position.

6. A fibre feeding device as in claim 1, wherein the pivot axis of each of said fibre feeding unit is eccentric with respect to the corresponding second rotating driving means when said fibre feeding unit is moved from rest position to working position and back to rest position.

* * * * *